US011415283B2

(12) United States Patent
Kessels et al.

(10) Patent No.: US 11,415,283 B2
(45) Date of Patent: Aug. 16, 2022

(54) RETROFIT LED LAMP FOR A VEHICLE LIGHT

(71) Applicant: Lumileds LLC, San Jose, CA (US)

(72) Inventors: Marcus Jozef Henricus Kessels, Echt (NL); Wilbert Heffels, Middelburg (NL)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 17/356,182

(22) Filed: Jun. 23, 2021

(65) Prior Publication Data

US 2021/0396370 A1 Dec. 23, 2021

Related U.S. Application Data

(60) Provisional application No. 63/042,716, filed on Jun. 23, 2020.

(30) Foreign Application Priority Data

Aug. 4, 2020 (EP) ..... 20189392

(51) Int. Cl.
*F21S 41/148* (2018.01)
*F21S 45/47* (2018.01)
(Continued)

(52) U.S. Cl.
CPC ..... *F21S 41/148* (2018.01); *F21S 45/47* (2018.01); *F21V 23/007* (2013.01); *F21V 23/06* (2013.01)

(58) Field of Classification Search
CPC ..... F21S 41/141–153; F21S 41/19–194; F21S 45/47–48; F21V 23/003–009; F21V 23/06
See application file for complete search history.

(56) References Cited

U.S. PATENT DOCUMENTS 9,970,622 B2 5/2018 Helbig et al.
10,415,787 B2 9/2019 Lessard et al.
(Continued)

FOREIGN PATENT DOCUMENTS

CN 110375261 A 10/2019
DE 10-2013-213782 A1 1/2015
(Continued)

OTHER PUBLICATIONS

From the EPO as the IDS, "Notification of Transmittal of the International Search Report and the Written Opinion of the International Searching Authority, or the Declaration", corresponding to PCT/US2021/038712, dated Aug. 31, 2021, 12 pages.
(Continued)

*Primary Examiner* — Jason M Han

(57) ABSTRACT

An LED lamp (1) for a vehicle light, the LED lamp (1) comprising a retrofit body (112) defining a longitudinal direction and being integrally configured as a heat sink, a conductive structure (13) being arranged in a cavity of the retrofit body (12) and at least one LED module (11) being electrically connected to the conductive structure (13), the at least one LED module (11) comprising a substrate (111) and a diode semiconductor (112) applied onto the substrate (111); a retrofit body (12), a conductive structure (13), and a method for manufacturing an LED lamp (1) for a vehicle.

18 Claims, 3 Drawing Sheets

(51) Int. Cl.
*F21V 23/00* (2015.01)
*F21V 23/06* (2006.01)

(56) References Cited

U.S. PATENT DOCUMENTS

| | | | | |
|---|---|---|---|---|
| 10,845,018 | B1 * | 11/2020 | Ueno | F21S 41/25 |
| 10,883,711 | B1 | 1/2021 | Zie | |
| 2019/0360681 | A1 | 11/2019 | Zhou et al. | |

FOREIGN PATENT DOCUMENTS

| | | | |
|---|---|---|---|
| DE | 102015201153 | A1 | 7/2016 |
| DE | 20-2018-000609 | U1 | 3/2018 |
| EP | 1496551 | A2 | 1/2005 |
| EP | 3287691 | A1 | 2/2018 |
| EP | 3441666 | A1 | 2/2019 |
| EP | 3537033 | A1 | 9/2019 |
| JP | 2013-229331 | A | 11/2013 |
| JP | 2014120388 | A | 6/2014 |

OTHER PUBLICATIONS

English language translation of DE 10-2013-213782, "Semiconductor lamp for a vehicle light", 6 pages.
The extended European search report corresponding to EP application 20189392.2, dated Nov. 17, 2020, 32 pages.

* cited by examiner

RETROFIT LED LAMP FOR A VEHICLE LIGHT

CROSS-REFERENCE TO RELATED APPLICATIONS

This application claims priority to U.S. Patent Application 63/042,716 filed Jun. 23, 2020 and to European Patent Application 20189392.2 filed Aug. 4, 2020, each of which is incorporated herein by reference in its entirety.

FIELD OF THE INVENTION

The invention relates to an LED lamp for a vehicle light, the LED lamp comprising a retrofit body defining a longitudinal direction and being integrally configured as a heat sink, a conductive structure being arranged in a cavity of the retrofit body and at least one LED module being electrically connected to the conductive structure, the at least one LED module comprising a substrate and a diode semiconductor applied onto the substrate. The invention further relates to a retrofit body for an LED lamp, a conductive structure for an LED lamp and a method for manufacturing an LED lamp for a vehicle light.

BACKGROUND OF THE INVENTION

Lamps for vehicle lights are available in many different configurations and are used to provide a vehicle light, e.g. a headlight of a vehicle, with a light source. Conventional lamps comprise a lamp base matching a lamp socket of the respective vehicle light, a bulb supported by the lamp base and filled with a gas, e.g. a halogen gas, and a filament arranged within the bulb and electrically connected to electrical contacts electrically connectable from outside.

Vehicle lights and corresponding lamps, respectively, provide lamp sockets and lamp bases matching each other and being standardized for economical and practical reasons. Exemplary lamp sockets for headlight halogen lamps are standardized for H4, H7 and H9 lamps to name only a few. Headlight halogen lamps matching one of these exemplary lamp sockets are configured for consuming an electrical power of 55 W, 60 W or 65 W.

Recently, LED lamps have been provided to be used instead of conventional lamps. LED lamps for replacing conventional lamps may also be referred to as LED retrofit bulbs although they usually do not comprise a bulb.

Such an LED lamp is configured for consuming a lower electrical power than a conventional lamp, e.g. in a range between 10 W and 20 W. The LED lamp usually comprises one or more, particularly two, LED modules. Each LED module of the LED lamp may have a layered structure comprising a plate-like substrate, one or more diode semiconductors applied to the substrate for emitting light and a luminescent layer applied to each diode semiconductor for converting e.g. blue light emitted by the diode semiconductor into white light emitted by the LED module.

The LED lamp further comprises a conventional lamp base for matching a respective lamp socket of a vehicle light and a retrofit body. The retrofit body is configured for supporting the one or more LED modules and arranging them, relative to the lamp base, essentially at a position of a filament of a conventional lamp.

Despite the lower electrical power being consumed a diode semiconductor generates a large quantity of heat during normal operation which has to be removed from the diode semiconductor, i.e. the diode semiconductor has to be cooled appropriately. As an LED lamp of the initially-mentioned kind is required to optically imitate a conventional lamp as close as possible the at least one diode semiconductor has to be concentrated in a very small spatial volume. However, removing the generated heat from the at least one diode semiconductor is the more difficult the smaller the spatial volume is.

As a higher operation temperature of the at least one diode semiconductor increases a risk of a defect of the at least one diode semiconductor, the service life of the LED lamp tends to be the shorter the better the LED lamp imitates a conventional lamp.

SUMMARY OF THE INVENTION

It is an object of the present invention to provide an LED lamp for a vehicle light which optically imitates a conventional lamp as close as possible having as long a service life as possible at the same time. Further objects of the invention are providing a retrofit body for an LED lamp and a conductive structure for an LED lamp and suggesting a method for manufacturing an LED lamp for a vehicle light.

The invention is defined by the independent claims. The dependent claims specify advantageous embodiments, respectively.

A first aspect of the invention is an LED lamp for a vehicle light, the LED lamp comprising a retrofit body defining a longitudinal direction and being integrally configured as a heat sink, a conductive structure being arranged in a cavity of the retrofit body and at least one LED module being electrically connected to the conductive structure, the at least one LED module comprising a substrate and a diode semiconductor applied onto the substrate. The conductive structure may comprise a printed circuit board (PCB) or a lead frame. The LED lamp is configured to replace a conventional lamp for a vehicle light, i.e. to be mounted in a conventional socket of the vehicle light thereby arranging the diode semiconductor essentially at a location of a filament of a conventional lamp being mounted in the vehicle light.

According to the invention, the substrate is attached to the retrofit body with at most a joining material being arranged between the substrate and the retrofit body. The joining material may comprise a thermally conductive adhesive or a solder paste. The diode semiconductor and the heat sink, i.e. the retrofit body, are only separated by the substrate and at most the joining material. A spatial distance between the diode semiconductor and the supporting retrofit body is as small as possible. Due to the small spatial distance the diode semiconductor may be arranged within a small focus volume being predetermined by a size of a filament of a conventional lamp. As a result, the LED lamp imitates a conventional lamp very well.

At the same time, the diode semiconductor and the retrofit body wholly acting as an effective heat sink are mechanically separated from each other as little as possible, i.e. thermally connected as intimate as possible. Due to the close thermal connection a heat transfer from the diode semiconductor to the retrofit body is improved. Due to the improved heat transfer an operating temperature of the diode semiconductor is lowered resulting in a longer service life of the diode semiconductor and, hence, the LED lamp. The retrofit body preferably comprises a support portion being laterally adjacent to a lateral opening of the retrofit body, the support portion supporting the at least one LED module. The support portion may be configured as a rectangular plate having a thickness in a range from 0.5 mm to 1.5 mm and preferably of 1 mm.

Advantageously, a finger-like portion of the conductive structure is arranged laterally adjacent to the support portion. The electrical contacts of the finger-like portion are close to the LED module allowing for a short electric connection of the LED module and the conductive structure.

In a preferred embodiment, the conductive structure is configured to be inserted into and fixed within a central bore of the retrofit body, the finger-like portion fitting in a duct of the retrofit body and comprising two electrical contacts for contacting the at least one LED module with the electrical contacts, in an inserted state of the conductive structure, being accessible through the lateral opening. Connecting the electrical contacts of the conductive structure to the contact elements of the LED module is facilitated by the lateral opening.

Advantageously, the central bore extends longitudinal from an end face of the retrofit body, and the duct extends longitudinal from a bottom portion of the central bore to the lateral opening. The central bore may accommodate a driver circuit for driving the LED module. The central bore preferably has a cylindrical shape or a rectangular cross-section. The duct may also have a cylindrical shape or a rectangular cross-section and allows the conductive structure for extending in the longitudinal direction to the lateral opening. The duct does not need to be completely enclosed but may have a lateral opening.

The duct may be arranged eccentrically with respect to the central bore. The eccentrical arrangement allows the conductive structure for being arranged laterally within the retrofit body.

In many embodiments, an edge region of the retrofit body surrounding the lateral opening widens in a light emission direction of the at least one LED module. The edge region may have a bevel or one or more steps for enlarging a maximum light emission angle of the at least one LED module.

In other embodiments, the LED lamp may comprise two LED modules being attached to opposite sides of the support portion. The two LED modules emit light in two opposite directions thereby better imitating a filament of a conventional lamp emitting light into a full spatial angle. The substrates of the LED modules usually have a thickness in a range from 0.5 to 1-5 mm and preferably of 1 mm. Accordingly, the opposing diode semiconductors are spaced apart by about 3 mm only which essentially corresponds to a diameter of a filament coil of a conventional lamp. The LED lamp may also comprise an even number of LED modules half of them being attached to each side of the support portion, respectively.

It is preferred that the conductive structure is arranged spaced apart from the substrate of the LED module. A heat transfer from the LED module to the conductive structure is reduced due to the spatial separation of the LED module and the conductive structure. The reduced heat transfer allows for a long service life of the conductive structure and, hence, the LED lamp.

In many embodiments, the LED lamp comprises a pair of conductive elements electrically connecting the at least one LED module to the electrical contacts of the conductive structure. Each conductive element may comprise a metal ribbon or a metal wire.

A second aspect of the invention is a retrofit body for an LED lamp to be mounted to a vehicle light, the retrofit body being integrally configured as a heat sink for at least one LED module and for supporting the at least one LED module, the retrofit body comprising a central bore extending longitudinal from an end face of the retrofit body, a lateral opening and a duct extending longitudinal from a bottom portion of the central bore to the lateral opening, wherein the central bore, the duct and the lateral opening are configured to accommodate a conductive structure, the conductive structure being configured to be inserted into and fixed within the central bore and comprising a finger-like portion fitting in the duct of the retrofit body, the finger-like portion comprising two electrical contacts for contacting the at least one LED module with the electrical contacts, in an inserted state of the conductive structure, being accessible through the lateral opening. The retrofit body may be provided as a semi-finished product which may be manufactured by molding and/or machining.

A third aspect of the invention is a conductive structure for an LED lamp to be mounted to a vehicle light, the conductive structure being configured to be inserted into and fixed within a retrofit body of an LED lamp, the retrofit body being integrally configured as a heat sink and comprising a central bore extending longitudinal from an end face of the retrofit body, a lateral opening, and a duct extending longitudinal from a bottom portion of the central bore to the lateral opening, wherein the conductive structure comprises a finger-like portion fitting in the duct of the retrofit body, the finger-like portion comprising two electrical contacts for at least one LED module, the electrical contacts being accessible through the lateral opening of the retrofit body in an inserted state of the conductive structure. The conductive structure may be provided as semi-finished product which may be manufactured in a usual way.

A fourth aspect of the invention is a method for manufacturing an LED lamp for a vehicle. The method comprises the steps of:

- providing, as a first semi-finished product, at least one LED module, the LED module comprising a substrate, a diode semiconductor applied onto the substrate and a luminescent layer applied onto the diode semiconductor;
- providing, as a second semi-finished product, a retrofit body being integrally configured as a heat sink for the at least one LED module, the retrofit comprising a central bore extending longitudinal from an end face of the retrofit body, a lateral opening, and a duct extending longitudinal from a bottom portion of the central bore to the lateral opening;
- attaching the substrate of the at least one LED module to the retrofit body adjacent to the lateral opening with at most a joining material being arranged between the substrate and the retrofit body;
- providing, as a third semi-finished product, a conductive structure configured to be inserted into and fixed within the central bore of the retrofit body, the conductive structure comprising a finger-like portion fitting in the duct of the retrofit body, the finger-like portion comprising two electrical contacts for contacting the at least one LED module with the electrical contacts being accessible through the lateral opening in an inserted state of the conductive structure;
- inserting the conductive structure into the central bore and the duct of the retrofit body; and
- electrically connecting the at least one LED module with the electrical contacts of the conductive structure via a pair of conductive elements.

The method allows for manufacturing the LED lamp very easily by assembling three semi-finished products wherein the first semi-finished product is thermally connected to the second semi-finished product and electrically connected to the third semi-finished product.

In many embodiments, electrically connecting the at least one LED module comprises an ultrasonic welding of the conductive elements both to the at least one LED module and to the electrical contacts of the conductive structure. The ultrasonic welding may be easily carried out as both the contact elements of the LED module and the electrical contacts of the conductive structure are accessible via the lateral opening of the retrofit body.

In a preferred embodiment, two LED modules are attached to the support portion of the retrofit body on opposite sides of the support portion.

It is an essential advantage of the LED lamp according to the invention that a conventional lamp is imitated very well due to a close sandwiching of diode semiconductors and a retrofit body of the LED lamp and a service life of the LED lamp is long due to an efficient cooling. Another advantage is the ease of manufacture due to using three semi-finished products during a final assembly.

It shall be understood that a preferred embodiment of the invention can be any combination of features of the dependent claims with the respective independent claims. Further advantageous embodiments are defined below.

BRIEF DESCRIPTION OF THE DRAWINGS

In the figures, like numbers refer to like objects throughout. Objects shown in the figures are not necessarily drawn to scale.

DETAILED DESCRIPTION OF THE EMBODIMENTS

Figure 1:
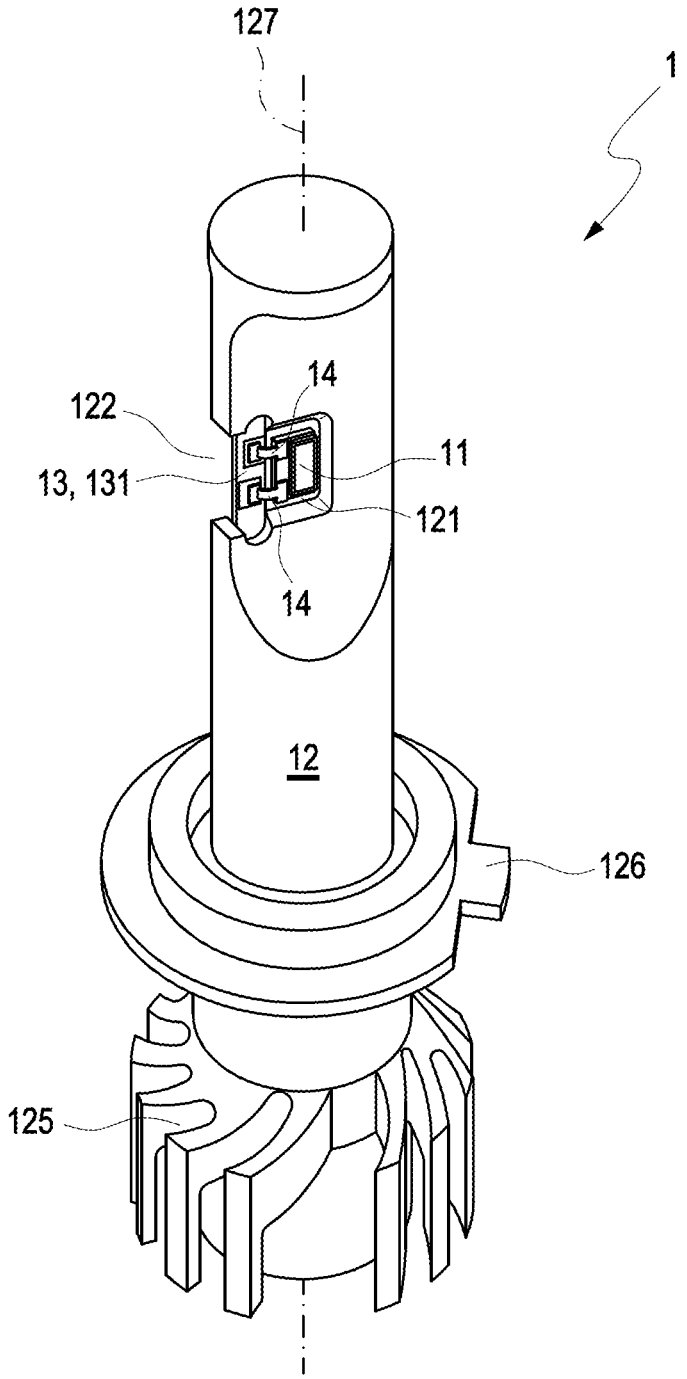
FIG. 1 schematically shows a perspective view of an LED lamp according to an embodiment of the invention.

FIG. 1 schematically shows a perspective view of an LED lamp 1 according to an embodiment of the invention. The LED lamp 1 may be mounted to a vehicle light, e.g. a head light of a vehicle. The LED lamp 1 comprises a retrofit body 12 defining a longitudinal direction 127. The retrofit body 12 may comprise a metal and is integrally configured as a heat sink which may have a plurality of fins 125 extending perpendicular to the longitudinal direction 127 from one end of the retrofit body 12.

The LED lamp 1 may also comprise a flange 126 for mounting the LED lamp 1 to a corresponding socket of the vehicle light. The flange 126 may comprise a plastic or consist of a plastic and may have an annular shape wherein the retrofit body 12 extends through the flange 126. In other embodiments the flange 126 may be an integral portion of the retrofit body.

The LED lamp 1 further comprises two LED modules 11 one of which is hidden in the figure.

Figure 2:
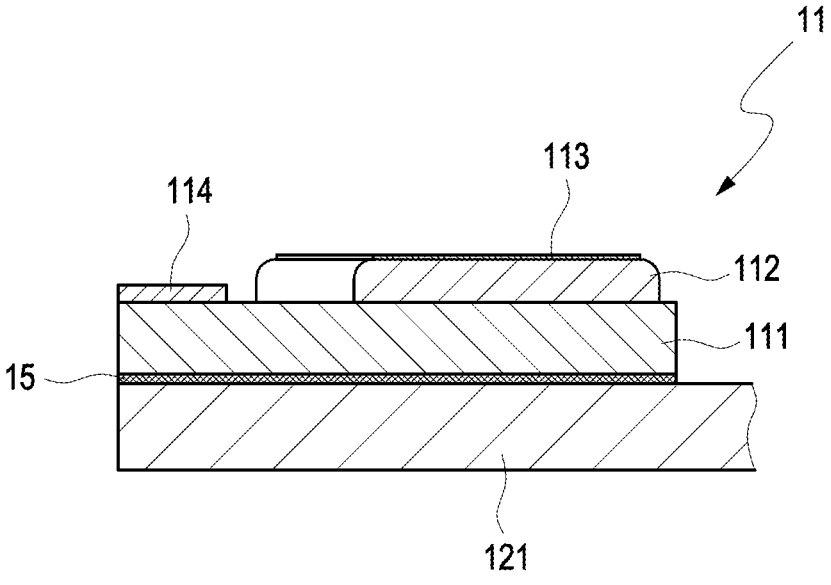
FIG. 2 schematically shows a lateral view of the LED module of the LED lamp shown in FIG. 1.

FIG. 2 schematically shows a lateral view of the LED module 11 mounted on the retrofit body 12 of the LED lamp 1 shown in FIG. 1. The LED module 11 comprises a plate-like substrate 111, a diode semiconductor 112 applied to the substrate 111 for emitting light and a luminescent layer 113 applied to the diode semiconductor 112 for converting e.g. blue light emitted by the diode semiconductor 112 into white light emitted by the LED module 11. Furthermore, the LED module 11 comprises a pair of electrical contact elements 114 which are electrically connected to the diode semiconductor 112. The substrate 111 is attached to the retrofit body 12, particularly a support portion 121 of the retrofit body 12, with a joining material 15 being arranged between the substrate 111 and the retrofit body 12.

The joining material 15 may be a thermally conductive adhesive or a solder paste. In different embodiments the joining material 15 may even be omitted. In these embodiments the substrate 111 may be immediately attached to the support portion 121. The immediate attachment may, for instance, be accomplished by ultrasonic welding or by riveting or screwing to name only a few possibilities.

Figure 3:
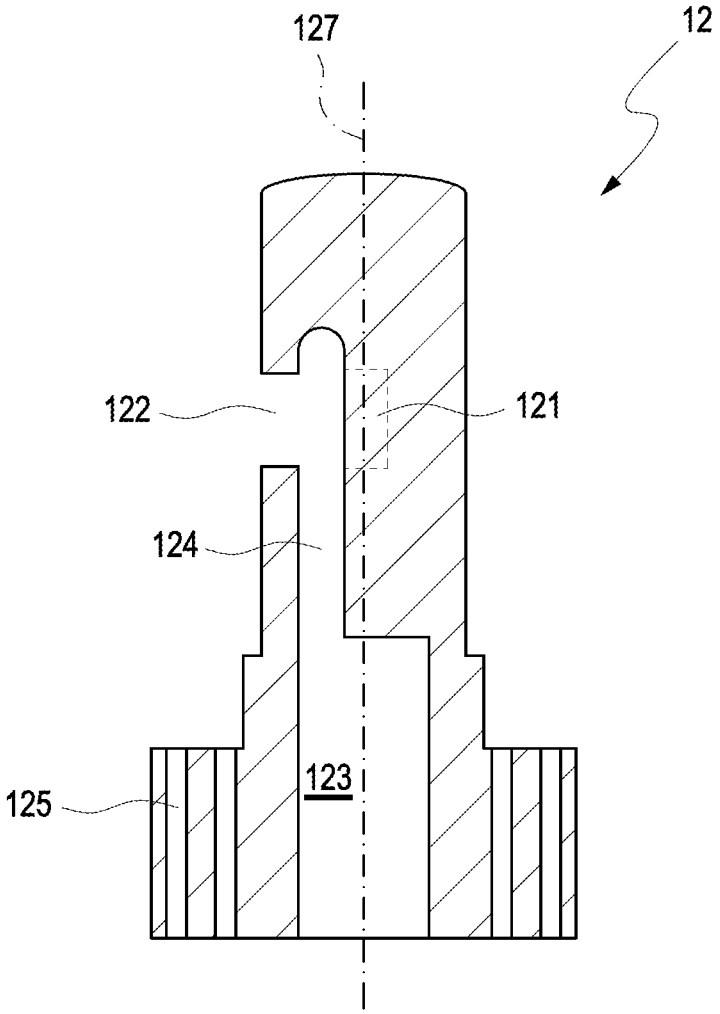
FIG. 3 schematically shows a cross-sectional view of the retrofit body of the LED lamp shown in FIG. 1.

FIG. 3 schematically shows a cross-sectional view of the retrofit body 12 of the LED lamp 1 shown in FIG. 1. The retrofit body 12 comprises a metal or consists of a metal, e.g. aluminum, and has a cavity which comprises a central bore 123 extending longitudinal from an end face of the retrofit body 12 and a duct 124 extending longitudinal from a bottom portion of the central bore 123 to a lateral opening 122 of the retrofit body 12. The duct 124 is arranged eccentrically with respect to the central bore 123. The central bore 123 has a cylindrical shape, but may have a different shape in other embodiments. An edge region of the retrofit body 12 surrounding the lateral opening 122 has bevels and widens in light emission directions of the LED modules 11 as can be best seen in FIG. 1. In other embodiments, the edge region may have one or more steps or a combination of bevels and steps.

The retrofit body 12 comprises a support portion 121 which is preferably configured plate-like with a thickness in a range of 0.5 mm to 1.5 mm and preferably of 1 mm. The support portion 121 is arranged laterally adjacent to the lateral opening 122. The support portion 121 supports both LED modules 11 which are attached to opposite sides of the support portion 121.

The retrofit body 12 may be provided as a semi-finished product in manufacturing the LED lamp 1. The retrofit body 12 is integrally configured as a heat sink for at least one LED module 11 and for supporting the at least one LED module 11. The retrofit body 12 comprises the central bore 123 and the duct 124. The duct 124 and the lateral opening 122 are configured to accommodate a conductive structure 13 of the LED lamp 1 which is described in detail below.

The LED lamp 1 further comprises a conductive structure 13 being arranged in the cavity of the retrofit body 12.

Figure 4:
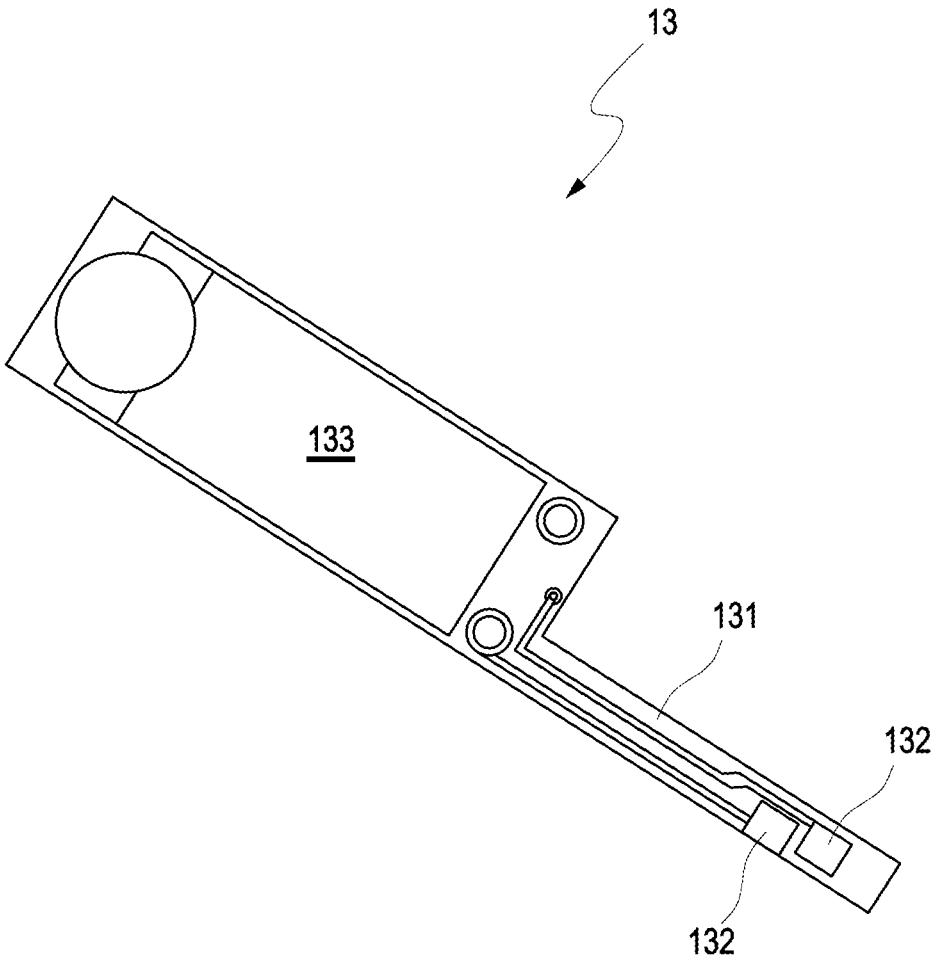
FIG. 4 schematically shows a top view of the conductive structure of the LED lamp shown in FIG. 1.

FIG. 4 schematically shows a top view of the conductive structure 13 of the LED lamp 1 shown in FIG. 1. The conductive structure 13 may comprise a printed circuit board (PCB) or a lead frame and is configured to be inserted into and fixed within the central bore 123: The conductive structure 13 may support a driver circuit 133 of the LED lamp 1 for driving the LED modules 11. The conductive structure 13 comprises a finger-like portion 131 fitting in the duct 124 of the retrofit body 12. The finger-like portion 131, in the inserted state of the conductive structure 13, is arranged laterally adjacent to the support portion 121 of the retrofit body 12.

The finger-like portion 131 comprises two pairs of electrical contacts 132 for contacting the at least one LED module 11 which are arranged on opposite sides of the finger-like portion 131 at a free end of the finger-like portion 131. The electrical contacts 132, in an inserted state of the conductive structure 13, are accessible through the lateral opening 122.

Each LED module 11 is electrically connected to the conductive structure 13. The LED lamp 1 comprises two pairs of conductive elements 14 electrically connecting the LED modules 11 to the electrical contacts 132 of the conductive structure 13. Each conductive element 14 is configured as a metal ribbon. In other embodiments, each conductive element may be configured as a metal wire.

The conductive structure 13 may be provided as a semi-finished product for manufacturing the LED lamp 1. The conductive structure 13 is configured to be inserted into and fixed within the retrofit body 12 of the LED lamp 1 and comprises a finger-like portion 131 fitting in the duct 124 of the retrofit body 12 with the finger-like portion 131 comprising two electrical contacts 132 for at least one LED module 11.

The LED lamp 1 for a vehicle is manufactured by carrying out the following steps. The LED modules 11 are provided as first semi-finished products. The retrofit body 12 is provided as a second semi-finished product. The two LED modules 11, i.e. the substrates 111 of the two LED modules 11, are attached to the retrofit body 12 adjacent to the lateral opening 122 with the joining material 15 being arranged between the substrate 111 and the retrofit body 12.

The conductive structure 13 is provided as a third semi-finished product. The conductive structure 13 is inserted into the central bore 123 and the duct 124 of the retrofit body 12. The LED modules 11 are electrically connected with the electrical contacts 132 of the conductive structure 13 each via a pair of the conductive elements 14. Electrically connecting the LED modules 11 may comprise an ultrasonic welding of the conductive elements 14 both to the LED modules 11 and to the electrical contacts 132 of the conductive structure 13.

Variations of the disclosed embodiments can be understood and effected by those skilled in the art, from a study of the drawings, the disclosure and the appended claims. In the claims, the word "comprising" does not exclude other elements or steps, and the indefinite article "a" or "an" does not exclude a plurality of elements or steps. The mere fact that certain measures are recited in mutually different dependent claims does not indicate that a combination of these measures cannot be used to advantage.

Any reference signs in the claims should not be construed as limiting the scope thereof.

REFERENCE SIGNS

1 LED lamp
11 LED module
111 substrate
112 diode semiconductor
113 luminescent layer
114 contact element
12 retrofit body
121 support portion
122 lateral opening
123 bore
124 duct
125 fin
126 flange
127 longitudinal direction
13 conductive structure
131 finger-like portion
132 electrical contact
133 driver circuit
14 contact element
15 joining material

The invention claimed is:

1. An LED lamp (1) for a vehicle light, the LED lamp (1) comprising:

a retrofit body (12) defining a longitudinal direction (127) and configured to dissipate heat, the retrofit body comprising a cavity including a central bore (123) and a duct (124) narrower than and extending from the central bore (123) to a lateral opening (122);

a conductive structure (13) comprising a driver circuit (133) arranged in the central bore (123) of the retrofit body (12) and a finger-like portion (131) narrower than and extending from the driver circuit (133), the finger-like portion (131) arranged in the duct (124) of the retrofit body (12);

at least one LED module (11) being electrically connected to the conductive structure (13) and configured to be driven by the driver circuit (133), the at least one LED module (11) comprising a substrate (111) and a diode semiconductor (112) disposed on the substrate (111), the substrate (111) being attached to the retrofit body (12) with a joining material (15) between the substrate (111) and the retrofit body (12).

2. The LED lamp (1) as claimed in claim 1, wherein the retrofit body (12) comprises a support portion (121) being laterally adjacent to the lateral opening (122) of the retrofit body (12), the support portion (121) supporting the at least one LED module (11).

3. The LED lamp (1) as claimed in claim 2, wherein the finger-like portion (131) of the conductive structure (13) is arranged laterally adjacent to the support portion (121).

4. The LED lamp (1) as claimed in claim 2, wherein the finger-like portion (131) comprises two electrical contacts (132) for contacting the at least one LED module (11) with the electrical contacts (132), the finger-like portion (131) being accessible through the lateral opening (122).

5. The LED lamp (1) as claimed in claim 4, comprising a pair of conductive elements (14) electrically connecting the at least one LED module (11) to the electrical contacts (132) of the conductive structure (13).

6. The LED lamp (1) as claimed in claim 4, wherein the central bore (123) extends longitudinal from an end face of the retrofit body (12), the lateral opening (122) and the duct (124) extending longitudinal from a bottom portion of the central bore (123) to the lateral opening (122).

7. The LED lamp (1) as claimed in claim 2, wherein an edge region of the retrofit body (12) surrounding the lateral opening (122) widens in a light emission direction of the at least one LED module (11).

8. The LED lamp (1) as claimed in claim 2, comprising two LED modules (11) being attached to opposite sides of the support portion (121).

9. The LED lamp (1) as claimed in claim 1, wherein the central bore (123) extends longitudinal from an end face of the retrofit body (12), and the duct (124) extends longitudinal from a bottom portion of the central bore (123) to the lateral opening (122).

10. The LED lamp (1) as claimed in claim 1, wherein the duct (124) is arranged eccentrically with respect to the central bore (123).

11. The LED lamp (1) as claimed in claim 1, wherein the conductive structure (13) is arranged spaced apart from the substrate (111) of the LED module (11).

12. The LED lamp (1) as claimed in claim 1, wherein the conductive structure comprises a printed circuit board or a lead frame.

13. The LED lamp (1) as claimed in claim 12, wherein the printed circuit board or lead frame is arranged in the central bore (123).

14. The LED lamp (1) as claimed in claim 1, further comprising a luminescent layer (113) disposed on the diode semiconductor (112).

15. The LED lamp (1) as claimed in claim 1, further comprising a plurality of fins (125) at least partially surrounding the central bore (123).

16. A method for manufacturing an LED lamp (1) for a vehicle, the method comprising:

providing at least one LED module (11), the LED module (11) comprising a substrate (111) and a diode semiconductor (112) applied onto the substrate (111);

providing a retrofit body (12) configured as a heat sink for the at least one LED module (11), the retrofit body (12) comprising a central bore (123) extending longitudinal from an end face of the retrofit body (12), a lateral opening (122), and a duct (124) extending longitudinal from a bottom portion of the central bore (123) to the lateral opening (122);

attaching the substrate (111) of the at least one LED module (11) to the retrofit body (12) adjacent to the lateral opening (122) with at most a joining material (15) being arranged between the substrate (111) and the retrofit body (12);

providing a conductive structure (13) configured to be inserted into and fixed within the central bore (123) of the retrofit body (12), the conductive structure (13) comprising a driver circuit (133) configured to drive the at least one LED module (11) and comprising a finger-like portion (131) fitting in the duct (124) of the retrofit body (12), the finger-like portion (131) narrower than and extending from the driver circuit (133), the finger-like portion (131) comprising two electrical contacts (132) for contacting the at least one LED module (11) with the electrical contacts (132), and, in an inserted state of the conductive structure (13), being accessible through the lateral opening (122);

inserting the driver circuit (133) of the conductive structure (13) into the central bore (123) and the finger-like portion (131) of the conductive structure (13) into the duct (124) of the retrofit body (12);

electrically connecting the at least one LED module (11) with the electrical contacts (132) of the conductive structure (13) via a pair of conductive elements (14).

17. The method as claimed in claim 16, wherein electrically connecting the at least one LED module (11) comprises an ultrasonic welding of the conductive elements (14) both to the at least one LED module (11) and to the electrical contacts (132) of the conductive structure (13).

18. The method as claimed in claim 16 or 17, wherein two LED modules (11) are attached to the support portion (121) of the retrofit body (12) on opposite sides of the support portion (121).

* * * * *